US010313792B2

(12) United States Patent
Lesso et al.

(10) Patent No.: US 10,313,792 B2
(45) Date of Patent: Jun. 4, 2019

(54) DIGITAL MICROPHONES

(71) Applicant: Cirrus Logic International Semiconductor Ltd., Edinburgh (GB)

(72) Inventors: John Paul Lesso, Edinburgh (GB); John Laurence Melanson, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 15/439,480

(22) Filed: Feb. 22, 2017

(65) Prior Publication Data

US 2017/0251303 A1 Aug. 31, 2017

Related U.S. Application Data

(60) Provisional application No. 62/300,599, filed on Feb. 26, 2016.

(30) Foreign Application Priority Data

Jun. 30, 2016 (GB) ..... 1611402.7

(51) Int. Cl.
*H04R 3/00* (2006.01)
*H04R 3/06* (2006.01)
(Continued)

(52) U.S. Cl.
CPC ..... *H04R 3/06* (2013.01); *H04R 3/00* (2013.01); *H04R 19/005* (2013.01); *H04R 19/04* (2013.01);
(Continued)

(58) Field of Classification Search
CPC ..... B81B 3/0027; B81B 2201/0257; H04R 19/005; H04R 19/04; H04R 3/00;
(Continued)

(56) References Cited

U.S. PATENT DOCUMENTS

2003/0095013 A1* 5/2003 Melanson ..... H02M 3/1584 332/109
2007/0172076 A1 7/2007 Mori et al.
(Continued)

FOREIGN PATENT DOCUMENTS

WO 2016109347 A1 7/2016

OTHER PUBLICATIONS

Combined Search and Examination Report under Sections 17 and 18(3), United Kingdom Intellectual Property Office, Application No. GB16114021, dated Aug. 25, 2016.
(Continued)

*Primary Examiner* — Yogeshkumar Patel
(74) *Attorney, Agent, or Firm* — Jackson Walker L.L.P.

(57) ABSTRACT

This application relates to methods and apparatus for digital microphones. Disclosed is a digital microphone apparatus (300) for outputting a digital output signal (DATA) at a sample rate defined by a received clock signal (CLK). The apparatus includes a band splitter (302) configured to receive a microphone signal ($S_{MD}$) indicative of an output of a microphone transducer and split said microphone signal into first signal path ($S_{P1}$) for frequencies in a first band and a second signal path ($S_{P2}$) for frequencies in a second band, the frequencies of the second band being higher than the frequencies in the first band. A modulation block (304) is configured to operate on the second signal path to apply a selective gain modulation to signals in the second signal path.

18 Claims, 3 Drawing Sheets

(51) Int. Cl.
*H04R 19/00* (2006.01)
*H04R 19/04* (2006.01)

(52) U.S. Cl.
CPC .... *H04R 2201/003* (2013.01); *H04R 2217/03* (2013.01); *H04R 2410/00* (2013.01); *H04R 2420/09* (2013.01); *H04R 2430/03* (2013.01); *H04R 2499/11* (2013.01)

(58) Field of Classification Search
CPC .. H04R 3/06; H04R 29/004; H04R 2201/003; H04R 2499/11; H04R 2217/03; H04R 2410/00; H04R 2430/03; H04R 2420/09; H02M 3/157; H04L 27/10; H04L 27/156
USPC ..... 381/120, 56, 98; 367/135, 137; 332/109
See application file for complete search history.

(56) References Cited

U.S. PATENT DOCUMENTS

2011/0150256 A1 6/2011 Baechler et al.
2011/0235466 A1 9/2011 Booij et al.
2012/0134238 A1* 5/2012 Surprenant ..... H04S 1/007 367/137
2015/0086043 A1* 3/2015 Sridharan ..... H04R 3/00 381/111
2015/0281836 A1* 10/2015 Nguyen ..... H04R 3/00 381/120
2016/0066113 A1* 3/2016 Elkhatib ..... H04R 29/004 381/56
2016/0192084 A1 6/2016 Oliaei
2017/0251302 A1 8/2017 Lesso et al.

OTHER PUBLICATIONS

Combined Search and Examination Report under Sections 17 and 18(3), United Kingdom Intellectual Property Office, Application No. GB1611401.9, dated Aug. 24, 2016.
International Search Report and Written Opinion of the International Searching Authority, International Application No. PCT/GB2017/050480, dated Apr. 20, 2017.
International Search Report and Written Opinion of the International Searching Authority, International Application No. PCT/GB2017/050479, dated Apr. 25, 2017.
Examination Report under Section 18(3), UKIPO, Application No. GB1611401.9, dated Jul. 17, 2018.

* cited by examiner

DIGITAL MICROPHONES

This application relates to methods and apparatus for operating digital microphones, and in particular to digital microphones operable to detect higher band acoustic and/or ultrasonic frequencies, especially for machine-to-machine communication.

BACKGROUND

Digital microphones are known and are increasingly being used in some applications, such as for portable electronic devices. FIG. 1 illustrates a conventional arrangement of a digital microphone in use. The digital microphone 101 comprises a transducer such as a MEMS microphone 102 with an associated amplifier 103, e.g. a low noise amplifier, and conversion block 104 co-located with the transducer 102. In some instances the amplifier 103 and conversion block 104 may be formed as an integrated circuit on the same semiconductor die as the transducer 102, but in other arrangements the amplifier 103 and conversion block 104 may be formed on a separate chip 105 to the transducer 102 but packaged together.

The conversion block comprises an analogue-to-digital converter 106 to convert the amplified microphone signal output from the amplifier 103 into a digital signal. In some instances the output of the ADC 106 may be used directly as the output DATA of the digital microphone 101, but in some instances the digital signal produced by the ADC 106 may be re-coded or modulated by a coder 107 into a particular data format, such as an oversampled PDM data stream. In some instances the function of the ADC 106 and coder 107 may be combined so that the conversion block 104 is a 1 bit PDM ADC.

In use the digital microphone will be coupled to an audio circuit 108, such as an audio codec. The audio codec 108 is part of a host electronic device (not illustrated) such as a mobile telephone or the like. The digital microphone 101 may also be part of the host device and thus the digital microphone may be connected to the codec via some suitable internal connective path. In general it is also known that a peripheral apparatus such as a headset or the like, which may be coupled to the host via some suitable connector such as a jack plug and socket or a USB connector, may comprise a digital microphone that, in use, communicates with the audio codec 108.

The audio codec 108 receives the data signal, DATA, output from digital microphone 101. The data signal DATA may comprise data bits output from the conversion block 107. Conventionally there may be limited signal processing in the digital microphone itself and, as mentioned the output DATA from the digital microphone may typically be an oversampled PDM data stream, although in some instances the modulator 107 may modulate the data to a PCM format.

The audio codec 108 may also control operation of the digital microphone 101. The audio codec 108 may provide a supply or bias voltage $V_{DD}$ to the digital microphone 101. Typically the digital microphone 101 may be controlled to be in a powered-up or powered-down state by the supply voltage $V_{DD}$. The digital microphone 101 may also have a sleep mode where it is powered by the supply voltage $V_{DD}$ but is effectively inactive.

In use in an active state the audio codec 108 may provide the digital microphone 101 with a clock signal CLK which is used for clocking the conversion block 104, e.g. ADC 106 and coder 107. The clock signal CLK provided by the audio codec 108 thus defines the bit rate of the output DATA signal in use.

As noted above the output (DATA) from the digital microphone 101 may be an oversampled PDM data stream. In some instances an oversampling ratio of around 64, for example, may be used. For a bandwidth of 24 kHz, comparable to a 48 kHz PCM signal, the sample rate for the PDM stream may be about 3.1 MHz. Thus the audio codec 108 may supply the clock signal CLK at around 3.1 MHz in use. Such a frequency of clock signal may be suitable for good quality audio.

In some instances however ultrasonic or near ultrasonic frequencies may be of interest. Ultrasonic detection has been proposed for uses such as proximity detection or gesture recognition where the host device may transmit ultrasonic waves and monitor for any reflection from a nearby object using a digital microphone. It has also been proposed to use ultrasonic or near ultrasonic frequencies as part of device-to-device communications.

In order that such ultrasonic and near-ultrasonic frequencies can be adequately recovered from the data signal DATA outputted by the digital microphone 101, the clock frequency required may be relatively high. For instance in some ultrasonic use cases a clock frequency of 5 MHz or so may be required for a conventional digital microphone.

Generally the higher the clock frequency the more power is consumed by the digital microphone 101 and also the downstream processing and the power required to transmit the digital signal DATA down a physical link. A high clock rate is thus undesirable, especially if the requirement to detect ultrasonic activity may be required for long periods of time even when there may be no activity to detect, e.g. a type of always on functionality listening for any activity.

SUMMARY

Thus according to an aspect of the invention there is provided a digital microphone apparatus for outputting a digital output signal at a sample rate defined by a received clock signal, the apparatus comprising:

a band splitter configured to receive a microphone signal indicative of an output of a microphone transducer and split said microphone signal into first signal path for frequencies in a first band and a second signal path for frequencies in a second band, the frequencies of the second band being higher than the frequencies in the first band; and a modulation block configured to apply a selective gain modulation to signals in the second signal path.

The modulation block may comprise a gain element in the second signal path and a gain controller for controlling a gain setting of the gain element. The modulation block may comprise a detector for detecting the power of any signal component in the second frequency band, wherein the gain controller is responsive to said power detector to control the gain setting. The controller may be configured to control the gain setting according to a predetermined transfer function of gain setting versus an output signal of said power detector.

The controller may be configured to control the gain setting based on the detected power of any signal component in the second frequency band so as to achieve a predetermined signal-to-noise ratio for such signal component in the digital output signal. The controller may be configured such that, for any signal components in the second frequency band where the detected power is above the threshold the gain setting is controlled to maintain a constant power output of the gain modulated signals in the second signal path.

The second signal path may comprise a band-pass filter upstream of the gain element with a pass-band corresponding to the second frequency band. The band-pass filter in the second signal path may be configured so that its pass-band is variable. The modulation block may comprise a band controller for varying the pass band of the band-pass filter and detecting any significant activity in the signal output from the band-pass filter.

The digital microphone apparatus may comprise a coder block for receiving signals from said first and second signal paths and encoding the signals to provide said digital output signal. The coder block may be operable so that the digital output signal is encoded in a 1 bit oversampled PDM format.

The microphone signal may be a digital microphone signal. The digital microphone signal may have a lower quantisation noise in the second band of frequencies than the digital output signal. There may be analogue-to-digital converter for receiving an analogue microphone signal and producing the digital microphone signal.

The apparatus may include a microphone transducer, the microphone signal being derived from the microphone transducer. The microphone transducer may be a MEMS capacitive microphone.

Embodiments relate to an electronic device comprising a digital microphone apparatus as described in any of the variants above and further comprising an audio codec, the audio codec being configured to, in use, receive the digital output signal. Embodiments also relate to an electronic device comprising a digital microphone apparatus as described in any of the variants above. The electronic device may be at least one of: a portable device, a battery powered device, a mobile telephone, an audio player, a video player, a computing device, a laptop, tablet or notebook computer, a games device, a wearable device and a voice activated device.

In a further aspect there is provided a digital microphone apparatus for outputting a digital output signal at a sample rate defined by a received clock signal, the apparatus comprising:

a band splitter configured to receive a microphone signal indicative of an output of a microphone transducer and split said microphone signal into first signal path for frequencies in a first band and a second signal path for frequencies in a second band, the frequencies of the second band being higher than the frequencies in the first band; and a modulation block comprising a detector for detecting the power of any signal component in the second frequency band, a gain element in the second signal path and a gain controller for controlling a gain setting of the gain element based on the detected power.

In a further aspect there is provided a digital microphone apparatus for outputting a digital output signal at a sample rate defined by a received clock signal, the apparatus comprising:

a band splitter configured to receive a microphone signal indicative of an output of a microphone transducer and split said microphone signal into first signal path for frequencies in a first band and a second signal path for frequencies in a second band, the frequencies of the second band being higher than the frequencies in the first band; and a modulation block configured to down-convert signals in the second frequency band to a third frequency band, wherein the third frequency band extends across a frequency range that is lower than the second frequency band.

The third frequency band may be different to and higher than the first frequency band. In some embodiments the third frequency band may be adjacent to the first frequency band.

The first frequency band may comprise a frequency range corresponding to voice audio and the second frequency band comprises a frequency range corresponding to ultrasonic frequencies.

The second signal path may comprise a mixer for mixing the signals in the second signal path with an oscillator signal. The second signal path may also comprise a band-pass filter downstream of the mixer with a pass-band corresponding to the third frequency band. The frequency of the oscillator signal may be offset from the centre frequency of the second frequency band by an amount defined by the third frequency band. A band-pass filter may be located upstream of the mixer with a pass-band corresponding to the second frequency band. In some embodiments the frequency of the oscillation signal may be variable, e.g. the modulation block may comprise an oscillator for generating the oscillation signal wherein the oscillator is configured such that the frequency of the oscillation signal is variable. At least one of the band splitter and the modulation block may be configured such the second frequency band is variable.

The modulation block may comprise a band controller for varying the second frequency band and detecting whether the second frequency band corresponds to any significant activity in the microphone signal. The band controller may detect whether the second frequency band corresponds to any significant activity in the microphone signal by detecting any significant signal component in the output of the band-pass filter. Alternatively the band controller may detect whether the second frequency band corresponds to any significant activity in the microphone signal by detecting any significant signal component in the down-converted signals in the third frequency band.

The microphone signal may be a digital microphone signal. The digital microphone signal may have a lower quantisation noise in the second band of frequencies than the digital output signal. The apparatus may include an analogue-to-digital converter for receiving an analogue microphone signal and producing the digital microphone signal.

The apparatus according to this aspect may comprise a coder block for receiving signals from the first and second signal paths and encoding the signals to provide said digital output signal. The coder block may be operable so that the digital output signal is encoded in a 1 bit oversampled PDM format.

The apparatus according to this aspect may comprise a microphone transducer, the microphone signal being derived from microphone transducer. The microphone transducer may be a MEMS capacitive microphone.

Embodiments relate to an electronic device comprising a digital microphone apparatus as described in any of the variants above and further comprising an audio codec, the audio codec being configured to, in use, receive the digital output signal. Embodiments also relate to an electronic device comprising a digital microphone apparatus as described in any of the variants above. The electronic device may be at least one of: a portable device, a battery powered device, a mobile telephone, an audio player, a video player, a computing device, a laptop, tablet or notebook computer, a games device, a wearable device and a voice activated device.

In another aspect there is provided a digital microphone apparatus for outputting a digital output signal at a sample rate defined by a received clock signal, the apparatus comprising:

a first signal path for frequencies in a first band; and a second signal path for frequencies in a second band, the frequencies of the second band being higher than the frequencies in the first band;

wherein the second signal path comprises a modulation block configured to down-convert signals to a third frequency band, wherein the third frequency band extends across a frequency range that is lower than the second frequency band.

In another aspect there is provided a digital microphone apparatus for outputting a digital output signal at a sample rate defined by a received clock signal, the apparatus comprising:

a band splitter configured to receive a microphone signal indicative of an output of a microphone transducer and split said microphone signal into first signal path for frequencies in a first band and a second signal path for frequencies in a second band, the frequencies of the second band being higher than the frequencies in the first band;

a coder configured to coder block for receiving signals from said first and second signal paths and encoding said signals to provide said digital output signal and a modulation block configured to control an encoding scheme used by said coder based on the signals in the second signal path.

Also provided is a digital microphone apparatus for outputting a digital output signal at a sample rate defined by a received clock signal, the apparatus comprising:

a band splitter configured to receive a microphone signal indicative of an output of a microphone transducer and split the microphone signal into first signal path for frequencies in a first band and a second signal path for frequencies in a second band, the frequencies of the second band being higher than the frequencies in the first band; and a modulation block configured to operate on the second signal path to emphasise any component of the microphone signal in the second frequency band in the digital output signal.

BRIEF DESCRIPTION OF THE DRAWINGS

The invention will now be described by way of non-limiting example only, with reference to the accompanying drawings, of which.

DESCRIPTION

Figure 1:
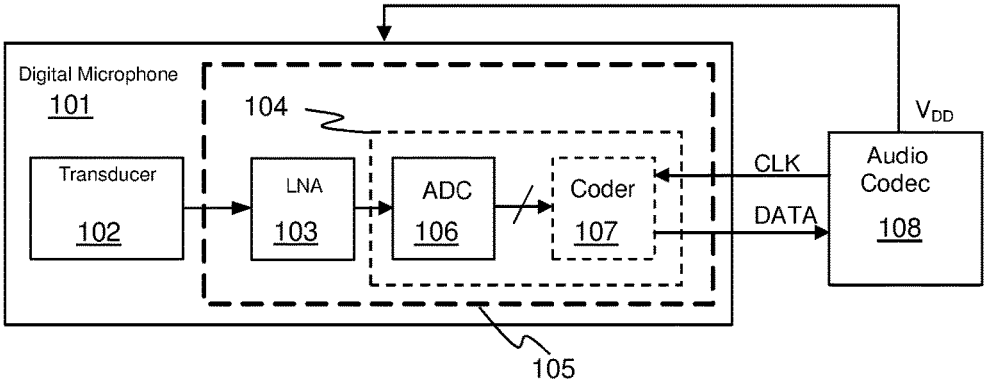
PRIOR ART Figure 1
FIG. 1 illustrates a conventional digital microphone arrangement.

As noted above a conventional digital microphone 101 such as illustrated in FIG. 1 may typically be arranged to provide an oversampled 1 bit PDM output, for example with an over-sampling ration of around 64. As will be understood by one skilled in the art using a 1 bit output introduces quantisation noise into the digital output signal, but by using a sufficiently high sampling rate the noise is shifted into higher frequencies and the level of quantisation noise in the audio band may be relatively low.

Figure 2:
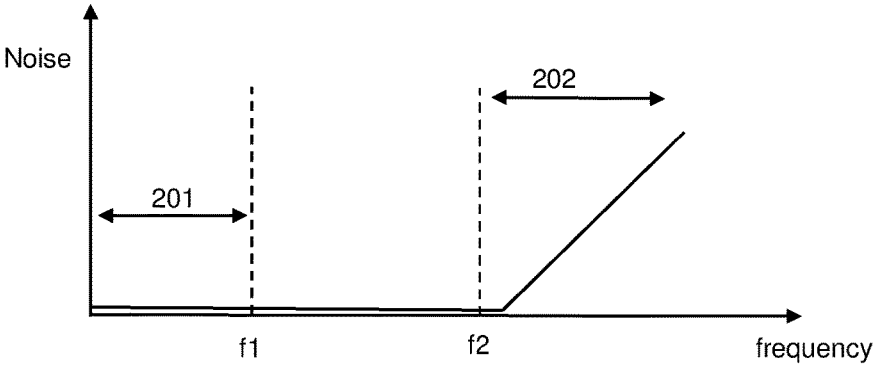
FIG. 2 illustrates an example of a noise transfer function for a digital microphone.

FIG. 2 illustrates a simplified plot of an example of a noise transfer function (NTF) for a digital microphone 101 with a 1 bit PDM data output and illustrates noise (i.e. output noise spectral density) against frequency. It can be seen that noise is relatively low at lower frequencies and then rises sharply for higher frequency components. The corner frequency (in this idealised example) depends on the sample rate of the PDM data stream.

In the audio codec 108, in order to recover the audio signals, the received DATA signal will typically be low-pass filtered and decimated to a higher-bit, lower sample rate format such as PCM (pulse-code-modulation) for example. A first signal band of interest may therefore be defined by the sample rate of the filtered and recoded PCM data. For standard telephony applications the sample rate may be around 8 kHz, allowing a signal band up to 4 kHz.

Provided the sample rate of the PDM data stream is set to be high enough most of the quantisation noise in the received PDM data stream DATA is outside of this audio band of interest and is removed by the subsequent low-pass filtering in the audio codec 108. For example FIG. 2 shows that a first band of interest 201, i.e. an audio band, may be defined with reference to an upper frequency of f1, which may for example correspond to a PCM sample rate of 8 kHz. In the example of FIG. 2 the PDM sample rate of the digital microphone 101, as set by the clock signal CLK, is fast enough, for example around 3 MHz, that most of the quantisation noise in the PDM data stream is well outside this band 201 of interest and thus does not appear in the recoded PCM output. However for ultrasonic or near ultrasonic frequencies a second band 202 of interest may extend from a lower frequency f2, which may be of the order of 20 kHz or 18 kHz or so, upwards. In the example illustrated in FIG. 2 it can be seen that at this example PDM sample rate, say around 3.1 MHz, the second frequency band 202 of interest extends over a part of the frequency spectrum where there is significant noise.

This noise will thus be present in the PDM data stream DATA output from the digital microphone making it difficult for the audio codec to recover information regarding any frequency components in this range—without relatively long term averaging to average out the random noise components, which may not be appropriate in many instances.

Conventionally to avoid significant noise in this ultrasonic frequency band the sample rate of the PDM data stream DATA may be increased, by increasing the frequency of the clock signal CLK, so that the noise is shaped to even higher frequencies.

Operating at very high clock frequencies, such as 5 MHz or higher, does however have an impact on power and requires use of high speed components.

Embodiments of the disclosure thus relate to methods and apparatus for digital microphones that encode a microphone signal indicative of incident pressure waves on a microphone transducer. The digital microphone encodes the output data in such a way so as to provide an acceptable signal-to-noise ratio (SNR) for relatively high frequencies in the microphone signal, e.g. ultrasonic and near ultrasonic frequencies, without having to use a very fast sample rate, e.g. a sample rate that shapes quantisation noise substantially to frequencies higher than the high frequency band of interest. The embodiments described thus improve the SNR for signals of interest in the high frequency band of the microphone signal, effectively improving the contrast of such signals, i.e. making the signals of interest distinct from the noise.

Various embodiments of the disclose use different techniques to improve the SNR for the high frequency signals of interest in the microphone signal. In some embodiments the high frequency signals of interest may be down-converted to a lower frequency. The down-converted signals may be down-converted to a frequency range that suffers from less quantisation noise when coded and output from the digital microphone. In some embodiments a gain may be selectively applied to the high frequencies of interest to emphasise such signals.

Some embodiments of the disclosure relate to a digital microphone apparatus for outputting a digital output signal at a sample rate defined by a received clock signal. The apparatus includes a band splitter which receives a microphone signal indicative of an output of a microphone transducer and splits the microphone signal into first signal path for frequencies in a first band and a second signal path for frequencies in a second band, the frequencies of the second band being higher than the frequencies in the first band. A modulation block is configured to operate on the second signal path such that any component of the microphone signal in the second frequency band has an acceptable SNR in the digital output signal without requiring an unduly high clock rate.

Figure 3:
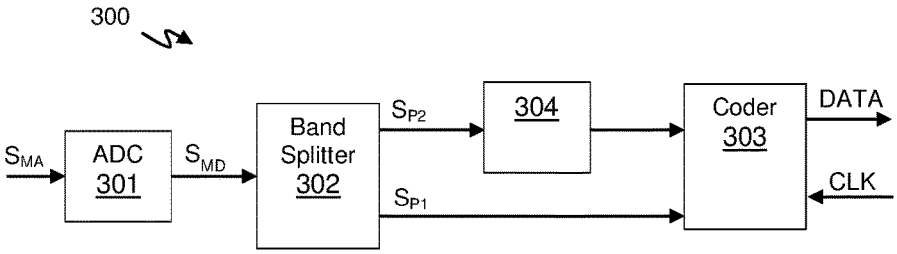
FIG. 3 illustrates a digital microphone apparatus according to an embodiment.

FIG. 3 illustrates a digital microphone apparatus 300 according to an embodiment. An ADC 301 receives an analogue microphone signal $S_{MA}$ indicative of the output of a microphone transducer (not shown in FIG. 3). As illustrated in FIG. 1 the transducer, which may for instance be a MEMS microphone, may generate an output which may be amplified by an amplifier to provide the analogue microphone signal $S_{MA}$. The ADC 301 converts the analogue microphone signal $S_{MA}$ into a digital microphone signal $S_{MD}$. The ADC 301 may provide a relatively high quality output signal with relatively low noise at both audio and ultrasonic frequencies. For example ADC 301 may be a multi-bit delta-sigma ADC, or may be a delta-sigma ADC operating at a higher sample rate than the sample rate of the output signal DATA.

A band-splitter 302 receives the digital microphone signal $S_{MD}$ and outputs band-split signals in first and second signal paths. The first signal path is for signal components having frequencies in a first band, which may be an audio band of interest. The first signal path may for instance be for frequencies below a first cut-off frequency and the signal $S_{P1}$ in the first signal path may be low-pass filtered by the band-splitter 302. The second signal path is for signal components having frequencies in a different, higher frequency band which may be a frequency band for ultrasonic and/or near-ultrasonic frequencies of interest, for instance frequencies of around 18 kHz or above. The second signal path may for instance be for frequencies above a second cut-off frequency and the signal $S_{P2}$ in the second signal path may be high-pass filtered by the band-splitter 302. The second cut-off frequency may be the same or different to the first cut-off frequency.

The signals in the first signal path may be provided to a coder block 303. The signals in the second signal path however are input to a modulation block 304 before being passed to the coder block. The modulation block 304 modulates the signal in the second signal path and/or the operation of the coder 303 to effectively improve the contrast or SNR of signals of interest in the second frequency band.

The coder 303 receives the signals $S_{P1}$ and $S_{P2}$ from the first and second signal paths and recodes the data into a desired format which is outputted as a digital output signal DATA. The coder 303 may be operable in a PDM output mode where the digital output signal DATA is a PDM data stream with a sample rate defined by the received clock signal CLK. In PDM output mode the coder block 303 may recombine the signals from the first and second signal paths and re-code the combined signal into PDM format.

In some embodiments the modulation block 304 operates to down-convert signals in the second frequency band to lower frequencies. The modulation block may down-convert signals in the second frequency band to a third frequency band. The third frequency band may be a frequency band which extends across a frequency range that is lower than the second frequency band but which is different to and higher than the first frequency band.

Figure 4:
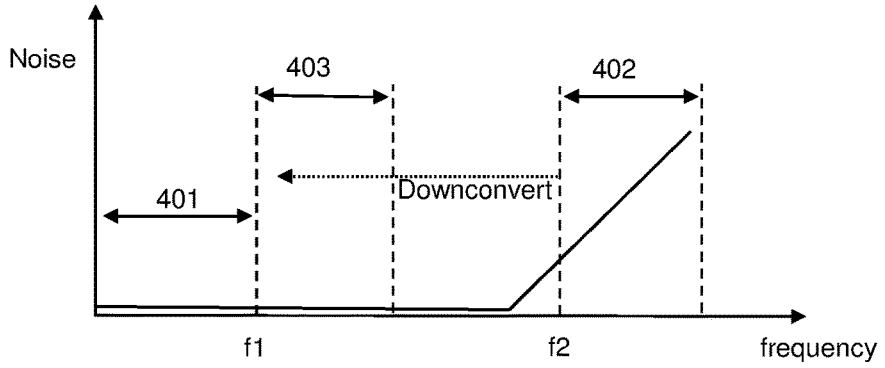
FIG. 4 illustrates the principles of down-converting a higher frequency band.

FIG. 4 illustrates the principle of down-converting a higher frequency band of interest. FIG. 4 illustrates the NTF of the digital microphone when looking at the digital output signal DATA. Signals in the first signal path correspond to a first, audio, frequency band, say from 0 Hz to the first cut-off frequency f1, which may for example be 4 kHz for an audio voice band (corresponding to a PCM sample rate of 8 kHz). As discussed previously signals in this band can be represented in the PDM output DATA with relatively low noise. Signals in the second signal path correspond to a second frequency band 402, say above a second frequency f2 which may for instance be around 18 kHz. Again as discussed previously there may be significant quantisation noise in the digital output signal DATA at these frequencies. The modulation block 304 may process signals in this band in the second signal path to down-convert, i.e. down-mix, them to a third frequency band 403. Down-converting the signals in the second frequency band into the lower third frequency band can thus move the signals of interest into a frequency band with lower noise in the digital output signal DATA and/or allow a lower clock frequency to be used for an acceptable SNR. Conveniently therefore the third frequency band may be as low as possible. In embodiments where the first and second signals paths are recombined into a single channel signal before recoding, the first and third frequency bands may not substantially overlap so as to avoid mixing an ultrasonic or near ultrasonic signal of interest into the audio band of interest. In such embodiments the third frequency band may be close to the first frequency band in terms of frequency and may, in some instances, be adjacent. By adjacent is meant that frequency range of the first frequency band over which any significant signal component may be expected does not overlap with, but is not significantly separated from, the frequency range of the third frequency band over which any significant signal component may be expected.

For example consider a voice band of interest extends from 0 to 4 kHz. Signals in a second frequency band of 18-22 kHz for example may be down-converted to signals in the third frequency band 403, which may for instance extend from 4-8 KHz. The signals of interest (i.e. any signals in the audio band together with any ultrasonic/near-ultrasonic signals) are thus encoded in a combined frequency band up to 8 kHz, corresponding to a Nyquist PCM sampling rate of 16 kHz. For an oversampled PDM data stream with an oversampling ratio of about 64 a sample rate of 1.024 MHz would thus allow the signals of interest to be encoded satisfactorily with good SNR.

It will of course be appreciated that any practical filter used for band splitting will transition from the passband to the non-passband over a range of frequencies and there is not a precise cut-off frequency or boundary at one particular frequency where the signal attenuation transitions from 0% to 100%. For the present disclosure the boundary of a frequency band defined by a filter or band-splitter may be taken to be the frequency at which a certain level of attenuation of signal components is achieved, say the −40 dB point for example. Thus in the example above the 4 kHz upper boundary of the first frequency band may correspond, for example, to the −40 dB point of a relevant low-pass filter.

The audio codec receiving the digital output signal DATA can then band-split the signal into the first and third frequency bands and convert to appropriately coded signals, e.g. PCM coded. If required the received signals in the third frequency band can be up-converted back to their native frequency, although in some embodiments it may be preferable to process the signals in that frequency band or convert to some other intermediate frequency.

Figure 5:
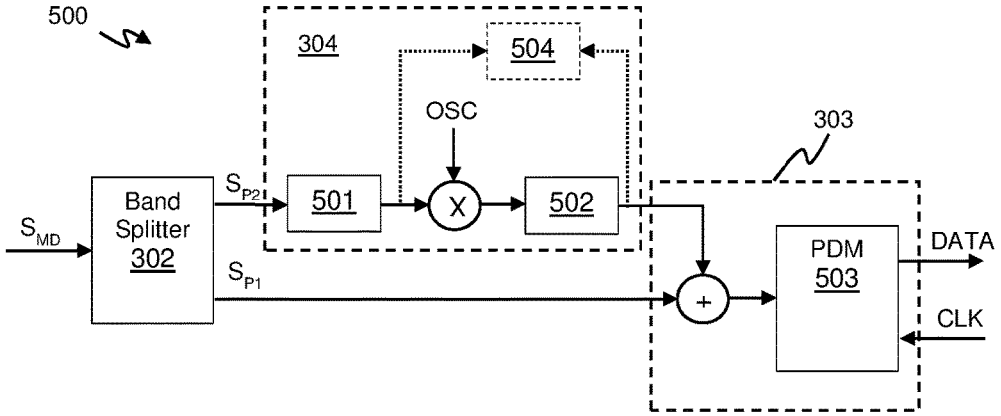
FIG. 5 illustrates one example of a digital microphone apparatus with down-conversion of a higher frequency band.

FIG. 5 illustrates a digital microphone apparatus 500 with one example of modulation block 304 for down-conversion of signal components in a frequency band in the second signal path. As discussed previously band-splitter 302 splits the digital microphone signal $S_{MD}$ into first and second signal paths, with higher frequency components in the second signal path. The modulation block 304 may, in some embodiments, comprise a filter 501 which, possibly together with band-splitter 302, provides a band-pass function in a first pass-band with a centre frequency based on the second frequency band of interest. In some embodiments filter 501 may be band-pass filter or the filter 501 may be a low-pass filter that acts in conjunction with a high-pass filter of the band-splitter to provide the first pass-band. In some embodiments where the band-splitter includes a band-pass filter the filter 501 may not be required. In any case the band-pass filtered signal is mixed with an oscillator signal OSC and the mixed signal is further band-pass filtered by a further band-pass filter 502. The further band-pass filter 502 is tuned to the third frequency band, i.e. the band of interest after down-conversion. The centre frequency of the second band-pass filter 502 is thus the centre frequency of the third frequency band. For the example discussed above, where the third frequency band extended from 4 to 8 kHz, the second band-pass filter 502 may thus band-pass filter between 4 and 8 kHz. The frequency of the oscillator signal OSC is offset from the centre frequency of the first pass-band by an amount defined by the third frequency band. For example the frequency of the oscillator signal OSC may be offset from the centre frequency of the first pass-band by an amount equal to the centre frequency of the third frequency band. Considering the example discussed above if the second frequency band of interest in the microphone signal corresponds to 18 to 22 kHz the centre frequency of the first band-pass filter may be 20 kHz and the oscillator signal may be at a frequency of 14 kHz.

A signal component in the second frequency band, say at 19 kHz for example, will thus be mixed with the oscillator signal and will generate a component in the mixed signal within the third frequency band, e.g. at 5 kHz in this example. This will be passed by the second band-pass filter as a 5 kHz signal. In this way the 19 kHz signal in the microphone signal is down-converted to a 5 kHz signal. It will of course be appreciated that the frequency of the oscillation signal could be offset to be higher than the centre frequency of the second frequency band of interest in the microphone signal, e.g. the oscillation signal OSC frequency could be set to be at a frequency 26 kHz. In some embodiments, especially if the oscillation signal is set to be offset higher than the centre frequency of the second frequency band of interest, a first band-pass filter 501 may be omitted.

This down-converted signal may then be recombined with the signal $S_{P1}$ from the first signal path and input to a PDM modulator 503 to produce the digital output signal DATA.

It will of course be appreciated that FIG. 5 illustrates only one example of down-conversion that may be suitable and one skilled in the art will be aware of other methods of down-conversion that may additionally or alternatively be implemented.

The second frequency band of interest may be a defined band which is relatively narrow. For instance a frequency band of around 18 to 20 kHz has been proposed for machine-to-machine communication. In some applications tones in this frequency band, which are generally inaudible, may be broadcast by one device to enable functionality or initiate a mode of operation of a portable electronic device, such as a smart phone or the like. Were this the only ultrasonic or near-ultrasonic band of interest then the first pass-band and frequency of the oscillation signal OSC may be pre-defined and may be substantially fixed in use. In some instances however there may be various different high frequency bands of interest. For example a frequency band around 20 kHz may be used for machine-to-machine communication and a frequency band around say 40 kHz may be of interest for object detection, e.g. for gesture recognition or proximity detection or the like.

Down-converting the entirety of such a frequency range, e.g. 18 to 45 kHz, may not be practical in a single down-conversion path and in any case even the down-converted signals would require significant bandwidth.

In practice it may be unlikely that a device needs to detect signals in different ones of such ultrasonic frequency bands simultaneously. In some embodiments therefore the second frequency band of interest in the second signal path may be variable. In some embodiments a relatively narrow second frequency band of interest may be scanned over a wider frequency range and the modulation block 304 may detect if there is any significant energy content in the microphone signal in that second frequency band. Thus for example the modulation block may comprise a band controller 504. The band-controller may vary the frequency of the oscillation signal in a controlled manner over time, for instance by varying the frequency in a defined sequence or performing a frequency sweep. If a first band-pass filter 501 is present and relatively narrow band the pass-band of the first band-pass filter 501 may be adjusted appropriately for the variation in oscillation frequency. The band controller 504 may detect any significant activity in the output of second band-pass filter 502. If a significant signal component in the output of the second band-pass filter is detected, indicating significant activity in the microphone signal in the band of interest, then the relevant oscillation signal frequency may be maintained for as long as there is significant activity in that band. Additionally or alternatively where the pass band of the first band-pass filter 501 is varied over time the output of the first band-pass filter 501 may be monitored for any significant activity.

As illustrated in FIG. 5 the signal $S_{P1}$ from the first signal path may be recombined with the processed signal from the second signal path, and re-coded to a PDM format for output as the digital output signal DATA.

In some instances however the coder block 303 may additionally or alternatively be operable to provide other data output formats. For example in some embodiments the coder 303 may be operable in a multi-channel data format where separate data channels may be transmitted in a time division manner and/or according to some frame format. For instance the coder 303 may be operable in a mode using the known Soundwire™ data format or other similar formats. In such an embodiment where multiple channels of data can be transmitted it would be possible to send data from the first and second signals paths as separate channels. Thus the data from the first signal path could be transmitted as a first channel of data. In order to encode signals in the voice audio band of 0 Hz to 4 kHz a sample rate of 8 kHz for that data channel would be required. The data from the second signal path could be transmitted as a second channel of data. As the second channel is transmitted separately from the first channel there is no need to combine the signals from the first and second signal paths. As such the third frequency band to which the relevant ultrasonic or near ultrasonic signals are down-converted in the second signal path may at least partly overlap with the first frequency band. Thus in this embodiment the third frequency band also extend from 0 Hz to 4 kHz say, again thus requiring a sample rate for data in the second channel of 8 kHz. To send both channels of data thus requires a combined sample rate of 16 kHz.

As an alternative to down-converting signals in the second signal band a gain may applied to signals in the second frequency band of interest, if present, to increase the contribution of such signals. Increasing the gain of the signal in the second signal band increases the signal component in that band, helping detection in that band. An increased gain is only applied in the relevant band and thus does not overload the coder or distort the audio band signal.

Figure 6:
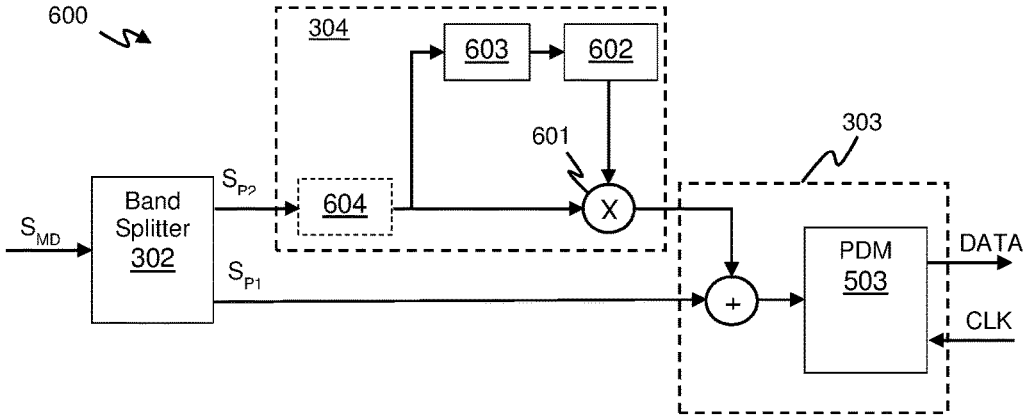
FIG. 6 illustrates one example of a digital microphone apparatus with a gain applied to a higher frequency band.

FIG. 6 illustrates one example of a digital microphone apparatus 600 in which the modulation block 304 applies a selective gain to any components of the microphone signal in the second frequency band of interest. As discussed previously band-splitter 302 splits the digital microphone signal $S_{MD}$ into first and second signal paths, with higher frequency components in the second signal path. The modulation block 304 in the second signal path includes a gain element 601 that applies a selective gain to the signal component in the second signal path. The gain is controlled by a controller 602 which controls a gain setting based on the detected power in the second frequency band of interest. A detector 603 may therefore determine the power of the signal components in the second frequency band in the second signal path and output a determined value to the controller 602. The power detector may determine a measure of the power of signal components in the second frequency band in any of a number of ways as would be understood by one skilled in the art, for instance by peak detection and/or time averaging of the signal components. The power detector may implement attack or decay time constants and/or hold times as desired. The controller 602 may implement a predetermined transfer function of gain setting versus the output of the power detector, i.e. the measure of determined power, to emphasise components in the second frequency band in the encoded digital output signal DATA. The gain setting may be controlled so that for any significant signal component in the second frequency band the signal is amplified to the extent necessary to effectively achieve a predetermined SNR in the digital output signal DATA. In some embodiments the gain setting may be controlled to provide a constant power output, at least for signal components where the power detected by the detector 603 is above some threshold value.

As described above in some instances the second frequency band of interest may be a known relatively narrow band in which case the band-splitter may pass only frequencies in the second frequency band to the second signal path or there may be a band-pass filter 604 in the second signal path to define the second frequency band. As also described above in some instances there may be a relatively wide range of frequencies of interest or separate bands in the near ultrasonic or ultrasonic range. In some embodiments there the controller may also be configured to vary the pass-band of a band-pass filter 604 in a similar fashion to that described previously until the power of a signal component in that frequency band is detected to above a threshold level by detector 603, at which point an appropriate gain setting may be applied as necessary.

In this way even though there may be noise in the relevant frequency band in the digital output signal DATA any significant signal components are emphasised as necessary to provide a reasonable SNR. Thus the audio codec can recover data regarding such signal components without requiring long time averaging. This may at least allow the audio codec or some other module receiving the data, to identify the presence of signals of interest in the higher frequency band, at which point it may be configured to increase the frequency of the clock signal to the digital microphone. In this way a relatively low frequency may be used for the clock signal supplied to the digital microphone until any ultrasonic activity is detected at which point the frequency of the clock signal may be increased. The higher frequency clock signal results in lower noise in the frequency band of interest but consumes more power but is only used once ultrasonic activity is detected.

Figure 7:
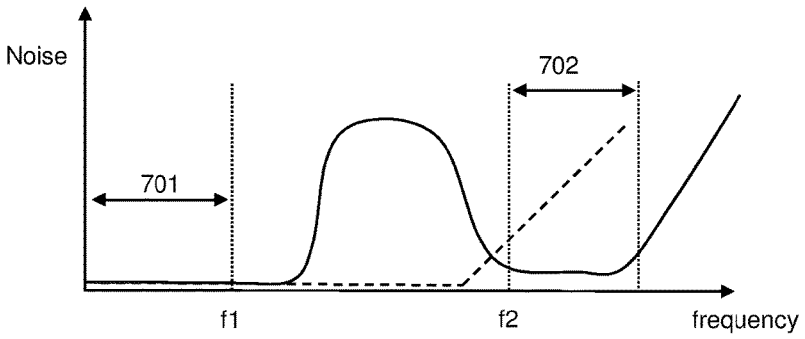
FIG. 7 illustrates the principles of implementing a desired noise transfer function (NTF) for the digital microphone.

As an alternative or addition to the methods described above in some embodiments the digital microphone apparatus may operate to vary the noise transfer function (NTF) of the digital microphone so as provide a first pass-band for signals in a first frequency band, e.g. an audio band, and a second pass-band for signals in a second frequency band, e.g. an ultrasonic and/or near ultrasonic band. This principle is illustrated in FIG. 7 which illustrates quantisation noise against frequency in the digital output signal DATA. The dashed plot illustrates the idealised example of a NTF of a conventionally encoded PDM digital output signal as discussed above with reference to FIG. 2. By varying the way that the PDM signal is encoded it is possible to vary the NTF of the coder, and hence the digital microphone, for a given sample rate. In other words without varying the frequency of the clock signal it is possible, by varying the encoding, to provide different forms of noise shaping so that quantisation noise is shaped to certain parts of the frequency spectrum. FIG. 7 illustrates two frequency bands of interest, a first frequency band 701, which may for example be a voice band extending from 0 Hz to 4 kHz, and a second frequency band 702 which may for instance be an ultrasonic/near ultrasonic band extending, for example, from 18 kHz to 22 kHz. By selecting an appropriate encoding scheme of the PDM coder, for instance based on signals detected in the second signal path, quantisation noise can be shaped out of the second frequency band of interest into lower frequency parts of the frequency spectrum which are not of interest, whilst maintaining relatively low noise in the first frequency band.

Figure 8:
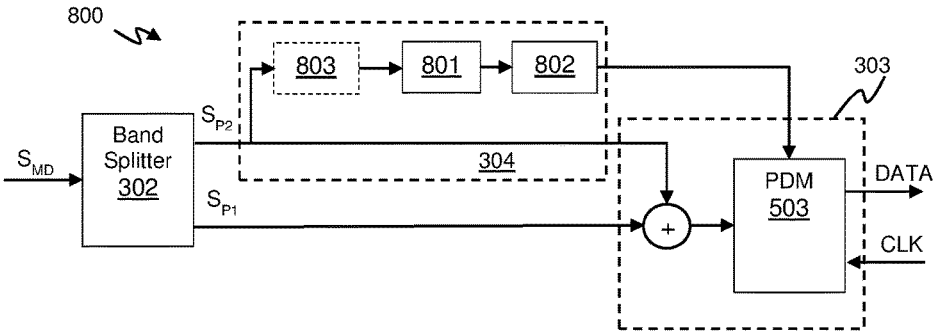
FIG. 8 illustrates one example of a digital microphone apparatus that implements a desired NTF for the digital microphone.

If the only second frequency band of interest were a predefined relatively narrow band of interest it may be possible to operate in a mode where a predetermined coding scheme is used to provide a predetermined NTF with effectively a notch or stop-band at the defined second frequency band. As discussed above however in practice there may be a range of ultrasonic and/or near-ultrasonic frequencies of possible interest and it may not be possible to provide low noise across the entirety of such a range. As also discussed above however in practice it may be unlikely that a device needs to detect signals in different ultrasonic frequency bands simultaneously. In some embodiments therefore the modulation block 304 may identify any activity in a relatively narrow second frequency band within the general range of interest and then control the coding scheme used to implement an appropriate NTF as illustrated in FIG. 8. FIG. 8 illustrates that the modulation block 304 may comprise a power detector 801 and a controller 802 for monitoring for any significant signal components in the signal in the second signal path. A band-pass filter 803 may be controlled to vary the second frequency band over time in a similar fashion as described above. In the event that any significant activity is detected in the relevant frequency band the controller may control the coder 303 to vary the encoding scheme used to implement a coding scheme with a NTF that has reduced noise in the relevant frequency band. The encoding scheme used may be defined by information stored in a look-up table or similar (not shown) based on the frequency at which activity was detected.

For all of the embodiments discussed above the digital microphone apparatus 300 may be operable in an ultrasonic contrast enhancement mode such as described to improve the SNR and/or contrast of any signals in an ultrasonic or near ultrasonic band of interest. In some embodiments the digital microphone apparatus may also be operable in a non-ultrasonic contrast enhancement mode of operation where the signal may not be split into separate signal bands. In other words the ability to provide the ultrasonic emphasis, whether through down-conversion, selective gain application and/or vary the NTF of the coding scheme may be able to be selectively disabled. The mode of operation may be signalled to the digital microphone and may, for example by controlled by the audio codec, for instance by varying the frequency of the clock signal or via some other signalling method.

In the embodiments described above the band-splitter 302 acts on the digital microphone signal $S_{MD}$ that is output from the ADC 301. This is a convenient and practical arrangement but it would be possible to apply band splitting to the analogue microphone signal $S_{MA}$ and convert separately to digital in each of the first and second signal paths.

Embodiments of the invention therefore relate to digital microphones that are operable to provide a digital data output that allows information regarding relatively high frequencies of interest, e.g. ultrasonic and near-ultrasonic frequencies, to be readily recoverable but without requiring very high clock rates. Such frequencies may correspond to frequency bands used for machine-to-machine communication. In general embodiments operate by splitting a relatively high quality microphone signal, indicative of the output of the microphone transducer, into high and low frequency paths and processes the high frequency path separately from the low frequency path so as to improve the ability to recover signals in (at least part of) the high frequency band from the output of the digital microphone (compared to the absence of such processing).

The digital microphone in use will be connected to suitable audio circuitry such as an audio codec of a host device. Such a digital microphone may be implemented in an electronic apparatus or host device, especially a portable and/or battery powered host device such as a mobile telephone, an audio player, a video player, a PDA, a mobile computing platform such as a laptop computer or tablet and/or a games device for example. This host device comprises an audio codec which may be connected to one or more on-board digital microphones according to embodiments of the invention. The audio codec may receive the digital data output signal output from the digital microphone and convert it to another format, such as PCM coding.

The audio codec may vary the clock signal CLK supplied to the digital microphone(s) to vary the operation of the digital microphone. The mode of operation may in some instances be specified by an applications processor. Data received from the digital microphone(s) in use may be communicated to the applications processor and/or stored in a memory and/or relayed to a communication module, e.g. for wireless transmission.

It should be noted that the above-mentioned embodiments illustrate rather than limit the invention, and that those skilled in the art will be able to design many alternative embodiments without departing from the scope of the appended claims. The word "comprising" does not exclude the presence of elements or steps other than those listed in a claim, "a" or "an" does not exclude a plurality, and a single feature or other unit may fulfil the functions of several units recited in the claims. Any reference numerals or labels in the claims shall not be construed so as to limit their scope. Terms such as amplify or gain include possibly applying a scaling factor of less than unity to a signal.

The invention claimed is:

1. A digital microphone apparatus for outputting a digital output signal at a sample rate defined by a received clock signal received by the digital microphone apparatus, the apparatus comprising:

a band splitter configured to receive a microphone signal indicative of an output of a microphone transducer and split said microphone signal into first signal path for frequencies in a first band and a second signal path for frequencies in a second band, the frequencies of the second band being higher than the frequencies in the first band; and a modulation block configured to apply a selective gain modulation to signals in the second signal path.

2. A digital microphone apparatus as claimed in claim 1 wherein the modulation block comprise a gain element in the second signal path and a gain controller for controlling a gain setting of the gain element.

3. A digital microphone apparatus as claimed in claim 2 wherein the modulation block comprises a detector for detecting the power of any signal component in the second frequency band, wherein the gain controller is responsive to said power detector to control the gain setting.

4. A digital microphone apparatus as claimed in claim 3 wherein the controller is configured to control the gain setting according to a predetermined transfer function of gain setting versus an output signal of said power detector.

5. A digital microphone apparatus as claimed in claim 3 wherein the controller is configured to control the gain setting based on the detected power of any signal component in the second frequency band so as to achieve a predetermined signal-to-noise ratio for such signal component in the digital output signal.

6. A digital microphone apparatus as claimed in claim 3 wherein the controller is configured such that, for any signal components in the second frequency band where the detected power is above the threshold the gain setting is controlled to maintain a constant power output of the gain modulated signals in the second signal path.

7. A digital microphone apparatus as claimed in claim 2 wherein the second signal path comprises a band-pass filter upstream of the gain element with a pass-band corresponding to the second frequency band.

8. A digital microphone apparatus as claimed in 7 wherein the band-pass filter in the second signal path is configured so that its pass-band is variable.

9. A digital microphone apparatus as claimed in claim 8 wherein the modulation block comprises a band controller for varying the pass band of the band-pass filter and detecting any activity above a defined threshold in the signal output from the band-pass filter.

10. A digital microphone apparatus as claimed in claim 1 comprising a coder block for receiving signals from said first and second signal paths and encoding the signals to provide said digital output signal.

11. A digital microphone apparatus as claimed in claim 10 where said coder block is operable so that the digital output signal is encoded in a 1 bit oversampled PDM format.

12. A digital microphone apparatus as claimed in claim 1 wherein said microphone signal is a digital microphone signal.

13. A digital microphone apparatus as claimed in claim 12 comprising an analogue-to-digital converter for receiving an analogue microphone signal and producing said digital microphone signal.

14. A digital microphone apparatus as claimed in claim 1 comprising a microphone transducer, the microphone signal being derived from the microphone transducer.

15. A digital microphone apparatus as claimed in claim 14 wherein said microphone transducer is a MEMS capacitive microphone.

16. An electronic device comprising a digital microphone apparatus as claimed in claim 1 and further comprising an audio codec, said audio codec being configured to, in use, receive said digital output signal.

17. An electronic device comprising a digital microphone apparatus as claimed in claim 1 wherein the electronic device comprises at least one of: a portable device, a battery powered device, a mobile telephone, an audio player, a video player, a computing device, a laptop, tablet or notebook computer, a games device, a wearable device and a voice activated device.

18. A digital microphone apparatus for outputting a digital output signal at a sample rate defined by a received clock signal, the apparatus comprising:

a band splitter configured to receive a microphone signal indicative of an output of a microphone transducer and split said microphone signal into first signal path for frequencies in a first band and a second signal path for frequencies in a second band, the frequencies of the second band being higher than the frequencies in the first band; and a modulation block comprising a detector for detecting the power of any signal component in the second frequency band, a gain element in the second signal path and a gain controller for controlling a gain setting of the gain element based on the detected power.

* * * * *